US007116758B2

(12) United States Patent
McKenna

(10) Patent No.: US 7,116,758 B2
(45) Date of Patent: Oct. 3, 2006

(54) POTTER-BUCKY GRID WITH COUNTER-WEIGHT

(75) Inventor: Gilbert W. McKenna, Revere, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 10/678,610

(22) Filed: Oct. 3, 2003

(65) Prior Publication Data

US 2004/0120465 A1 Jun. 24, 2004

Related U.S. Application Data

(60) Provisional application No. 60/415,680, filed on Oct. 3, 2002.

(51) Int. Cl.
*G21K 1/00* (2006.01)

(52) U.S. Cl. ..... 378/155

(58) Field of Classification Search ..... 378/154, 378/155

See application file for complete search history.

(56) References Cited

U.S. PATENT DOCUMENTS

| | | | | |
|---|---|---|---|---|
| 3,980,407 | A * | 9/1976 | Hill | 355/71 |
| 4,039,836 | A | 8/1977 | Shaw, IV | |
| 4,063,100 | A | 12/1977 | Williams | |
| 4,982,419 | A * | 1/1991 | Horikawa | 378/155 |
| 5,305,369 | A | 4/1994 | Johnson | |
| 6,088,427 | A * | 7/2000 | Pagano | 378/155 |

* cited by examiner

*Primary Examiner*—Craig E. Church
(74) *Attorney, Agent, or Firm*—McDermott Will & Emery LLP

(57) ABSTRACT

A Potter-Bucky device for a radiation image recording apparatus in which an image recording medium is exposed to radiation which has passed through an object in order to record a radiation image of the object on the recording medium includes a grid which is movably supported between the object and the recording medium and is reciprocated parallel to the recording medium. A counter-weight is connected to the grid and is reciprocated in synchronization with the grid but in an opposite direction. Among other benefits and features, the disclosure reduces or eliminates vibrations produced by the reciprocating grid.

24 Claims, 6 Drawing Sheets

POTTER-BUCKY GRID WITH COUNTER-WEIGHT

CROSS-REFERENCE TO RELATED APPLICATION

The present application claims priority from U.S. Provisional Patent Application Ser. No. 60/415,680 filed on Oct. 3, 2002, which is assigned to the assignee of the present application and incorporated herein by reference.

FIELD OF THE DISCLOSURE

The present disclosure relates to a Potter-Bucky device for use in a radiation image recording apparatus, and more particularly to a Potter-Bucky device having a movable counter-weight arranged to reduce vibrations produced by a moving grid of the Potter-Bucky device.

BACKGROUND OF THE DISCLOSURE

One of the most effective ways to reduce scattered radiation from an object being radiographed is through the use of a Potter-Bucky device. The Potter-Bucky device is used with most diagnostic x-ray equipment. More commonly known as a 'bucky', this is an assembly which is normally located under the table of a diagnostic x-ray set and holds the x-ray film cassette and a secondary radiation grid. The grid is used to prevent secondary x-ray emission from the patient from reaching the x-ray film, and is formed from a large number of thin strips of lead separated by a radiolucent material. To prevent the outline of the grid from appearing on the film, a mechanism is provided for rapidly moving the grid in a reciprocating manner during exposure.

However there is a problem in that, though rapidly moving the grid prevents the outline of the grid from appearing on the film, rapidly moving the grid is also apt to transmit vibrations to other parts of the x-ray system. What is still desired, therefore, is a new and improved Potter-Bucky device for use with medical diagnostic imaging and scanner systems. In particular, what is desired is a new and improved Potter-Bucky device that prevents grid outlines from appearing on x-ray film, but transmits less vibrations to other parts of the x-ray system.

SUMMARY OF THE DISCLOSURE

The present disclosure provides a new and improved Potter-Bucky device for use with medical diagnostic imaging and scanner systems. The Potter-Bucky device is for a radiation image recording apparatus in which an image recording medium is exposed to radiation which has passed through an object in order to record a radiation image of the object on the recording medium includes a grid which is movably supported between the object and the recording medium and is reciprocated parallel to the recording medium. A counter-weight is connected to the grid and is reciprocated in synchronization with the grid but in an opposite direction.

Among other features and advantages, a new and improved Potter-Bucky device constructed in accordance with the present disclosure reduces or eliminates the vibrations created by the moving grid of the device.

The present disclosure also provides a method for moving a grid in a Potter-Bucky device. The method includes movably supporting the grid for reciprocating motion in a plane, positioning at least one movable cam adjacent the grid, moving the cam to cause reciprocating movement of the grid in the plane, and attaching a counter-weight to the grid for reciprocating motion in the plane in directions opposite the grid.

Another Potter-Bucky device according to the present disclosure includes a frame, tracks secured to the frame, a first set of brackets slidably received in the tracks for supporting a grid, a second set of brackets slidably received in the tracks, a counter-weight secured to the second set of brackets, a drive pulley and an idler pulley secured to the frame, and a continuous belt extending around the drive pulley and the idler pulley such that the belt include first and second portions which move in opposite directions between the pulleys upon rotation of the drive pulley. The first set of brackets is secured to the first portion of the continuous belt and the second set of brackets is secured to the second portion of the continuous belt. The counter-weight reduces or eliminates vibrations created by reciprocating movement of a grid secured to the frame.

The foregoing and other features and advantages of the present disclosure will become more readily apparent from the following detailed description of the disclosure, as illustrated in the accompanying drawing.

BRIEF DESCRIPTION OF THE DRAWINGS

Like reference characters designate identical or corresponding components and units throughout the several views.

DETAILED DESCRIPTION OF EXEMPLARY EMBODIMENTS

Figure 1:
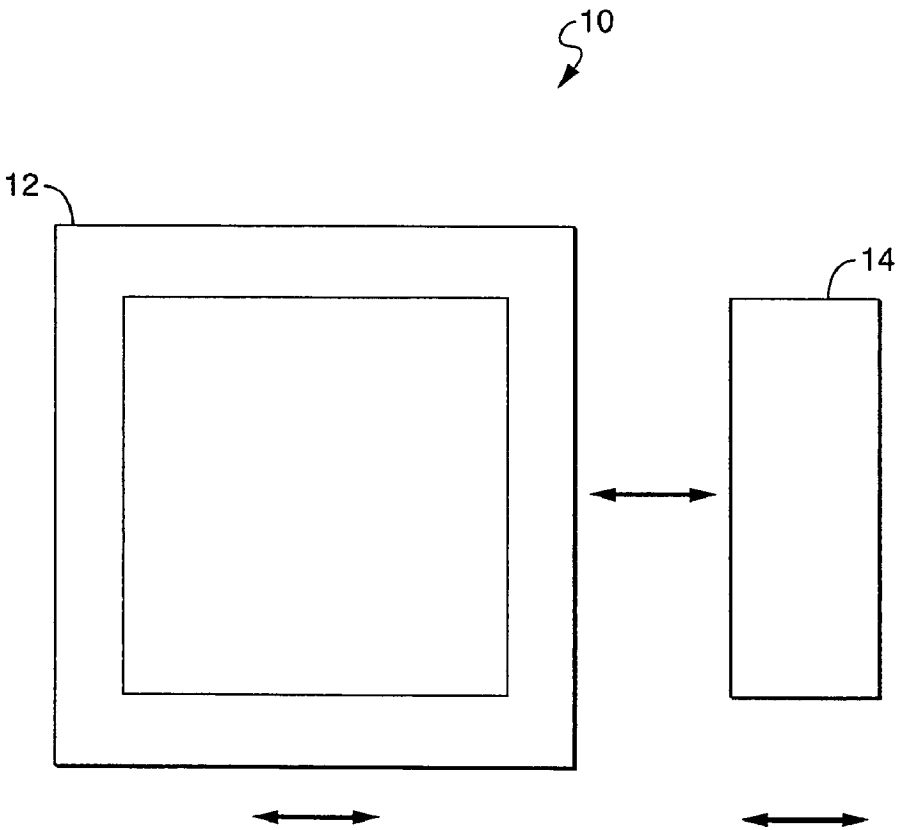
FIG. 1 is a top plan view of an exemplary embodiment of a grid and a counter-weight of a Potter-Bucky device constructed in accordance with the present disclosure.

Referring first to FIG. 1, an exemplary embodiment of a Potter-Bucky device 10 constructed in accordance with the present disclosure is shown. The Potter-Bucky device 10 is for being positioned in a radiation image recording apparatus (not shown, but for example a computer tomography scanner) for exposing an image recording medium to radiation which has passed in a first plane through an object (not shown, but for example a patient lying over the Potter-Bucky device) to the recording medium in order to record a radiation image of the object on the recording medium. Among other features and advantages, the new and improved Potter-Bucky device 10 constructed in accordance with the present disclosure reduces or eliminates the vibrations created by a moving grid 12 of the device.

The Potter-Bucky device 10 generally includes the grid 12, which is movably supported for reciprocating motion in a second plane extending parallel to the recording medium between the object and the recording medium, and a counter-weight 414 movably supported and operatively connected to the grid for reciprocating motion in the second plane in directions opposite the grid. A mass of the grid 12 is substantially equal to a mass of the counter-weight 14, and an inertia of the grid is equal to an inertia of the counter-weight during reciprocating motion.

With this arrangement, the vibration caused by the displacement of the center of gravity of the Potter-Bucky device 10 due to the movement of the grid 12 is compensated for by the movement of the counter-weight 14, and accordingly, no vibration is transmitted to parts of the radiation image recording apparatus using the Potter-Bucky device.

Although not shown in FIG. 1, the Potter-Bucky device 10 preferably includes at least one movable cam positioned adjacent the grid 12 for causing reciprocating movement of the grid in the second plane upon movement of the cam. Even more preferably, the cam is also arranged so as to also cause reciprocating motion of the counter-weight 14 in the second plane in directions opposite the grid 12. Although not shown in FIG. 1, the Potter-Bucky device 10 also includes at least one spring biasing the grid 12 against the cam and biasing the counter-weight 14 against the cam.

Figure 2:
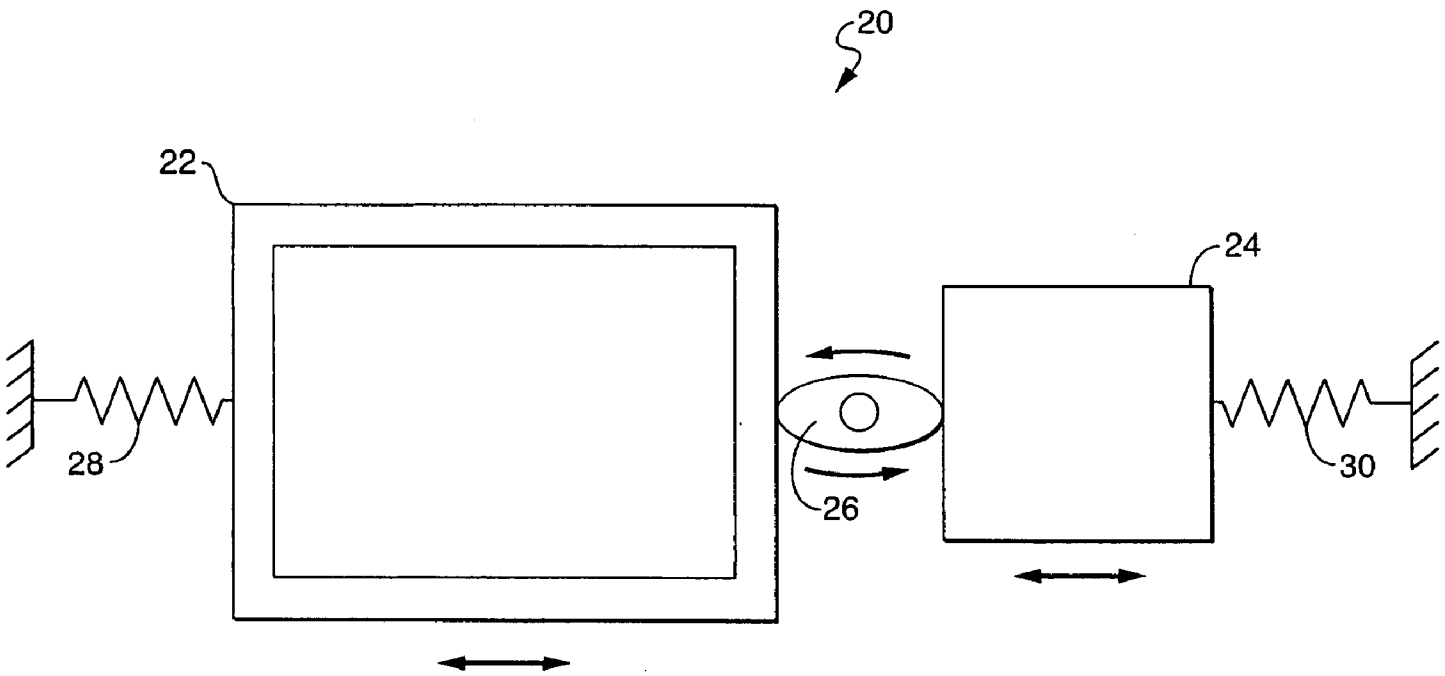
FIG. 2 is a top plan view of another exemplary embodiment of a grid and a counter-weight of a Potter-Bucky device constructed in accordance with the present disclosure.

FIG. 2 is a top plan view of another exemplary embodiment of a grid 22 and a counter-weight 24 of a Potter-Bucky device 20 constructed in accordance with the present disclosure. In the embodiment of FIG. 2, the cam comprises a single, rotatable, elliptical cam 26 positioned between the grid 22 and the counter-weight 24, so that rotation of the cam 26 causes opposing reciprocating motion of both the grid and the counterweight. Although not shown, the Potter-Bucky device 20 also includes a motor, such as an electric rotary motor, operatively connected to the cam 26 for causing rotary movement of the cam adjacent the grid 22.

In the exemplary embodiment of FIG. 2, the spring of the Potter-Bucky device 20 comprises first and second helical compression springs 28, 30, and the grid 22 is positioned between the first spring 28 and the cam 26, and the counter-weight 24 is positioned between the second spring 30 and the cam 24. In effect then, the grid 22 and the counter-weight 24 are pushed together by the springs, 28, 30 and against the cam 26.

Figure 3:
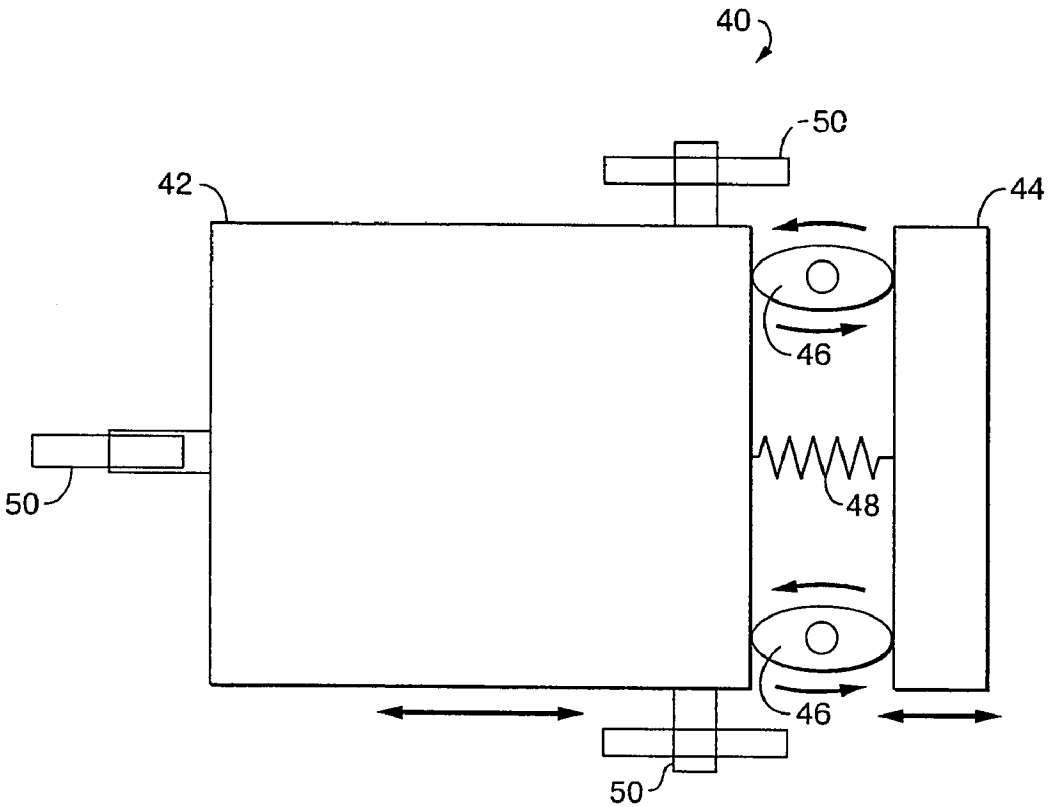
FIG. 3 is a top plan view of a further exemplary embodiment of a grid and a counter-weight of a Potter-Bucky device constructed in accordance with the present disclosure.

FIG. 3 is a top plan view of a further exemplary embodiment of a grid 42 and a counter-weight 44 of a Potter-Bucky device 40 constructed in accordance with the present disclosure. In the embodiment of FIG. 3, the cam comprises two, rotatable, elliptical cams 46 positioned between the grid 42 and the counter-weight 44, so that rotation of the cams 46 causes opposing reciprocating motion of both the grid and the counterweight. Although not shown, the Potter-Bucky device also includes motors, such as electric rotary motors, operatively connected to the cams 46 for causing rotary movement of the cams adjacent the grid 42 and the counter-weight 44.

In the exemplary embodiment of FIG. 3, the spring of the Potter-Bucky device 40 comprises a single helical tension spring 48 connected between the grid 42 and the counter-weight 44. In effect then, the grid 42 and the counter-weight 44 are pulled together by the spring 48 and against the cam 46.

In the exemplary embodiment of FIG. 3, the grid 42 is shown movably supported by linear bearings 50. It should be understood, however, that a Potter-Bucky device constructed in accordance with the present disclosure can be provided with other types of supports for movably supporting the grid and the counter-weight for reciprocating motion.

Figure 4:
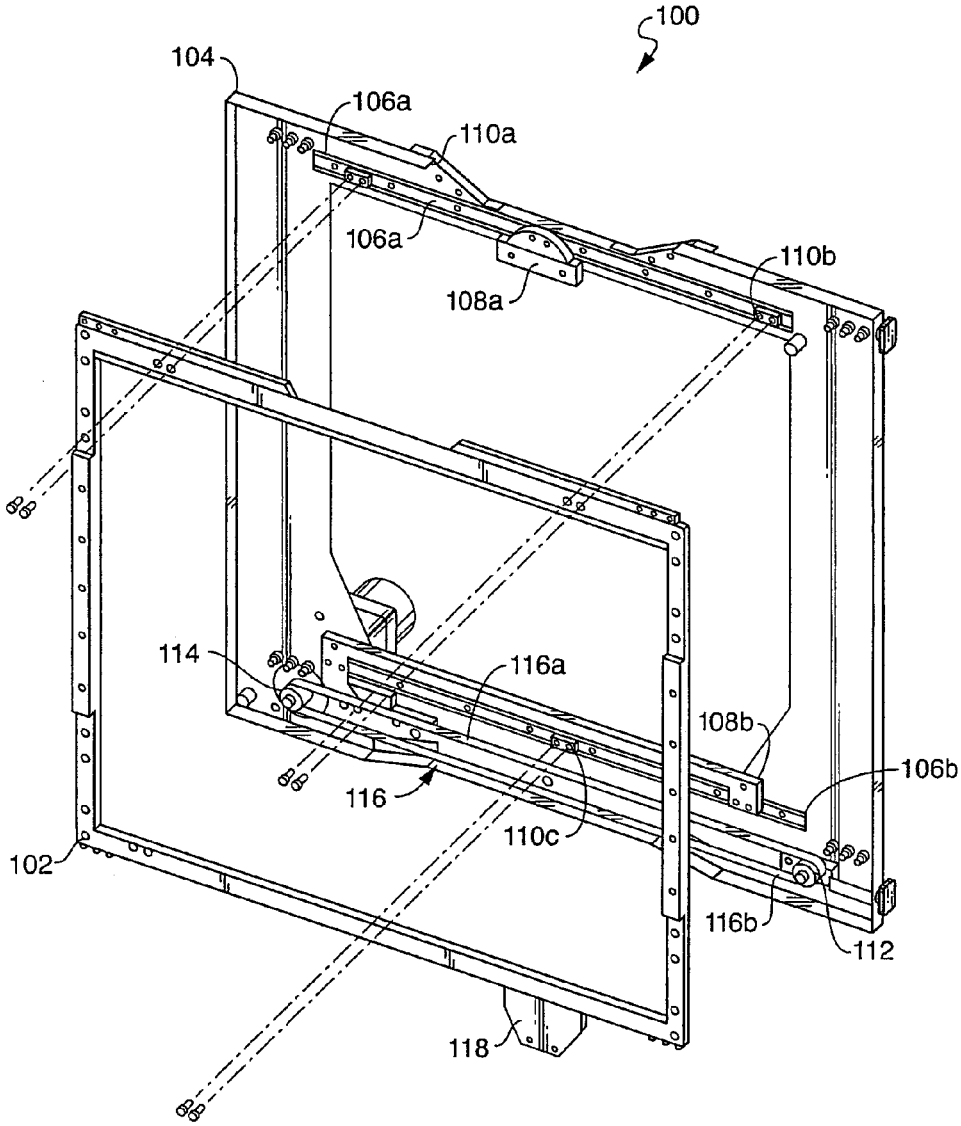
FIG. 4 is an explode, front perspective view of an exemplary embodiment of a portion of a Potter-Bucky device constructed in accordance with the present disclosure and including a frame assembly for supporting a grid and having a counter-weight.
Figure 5:
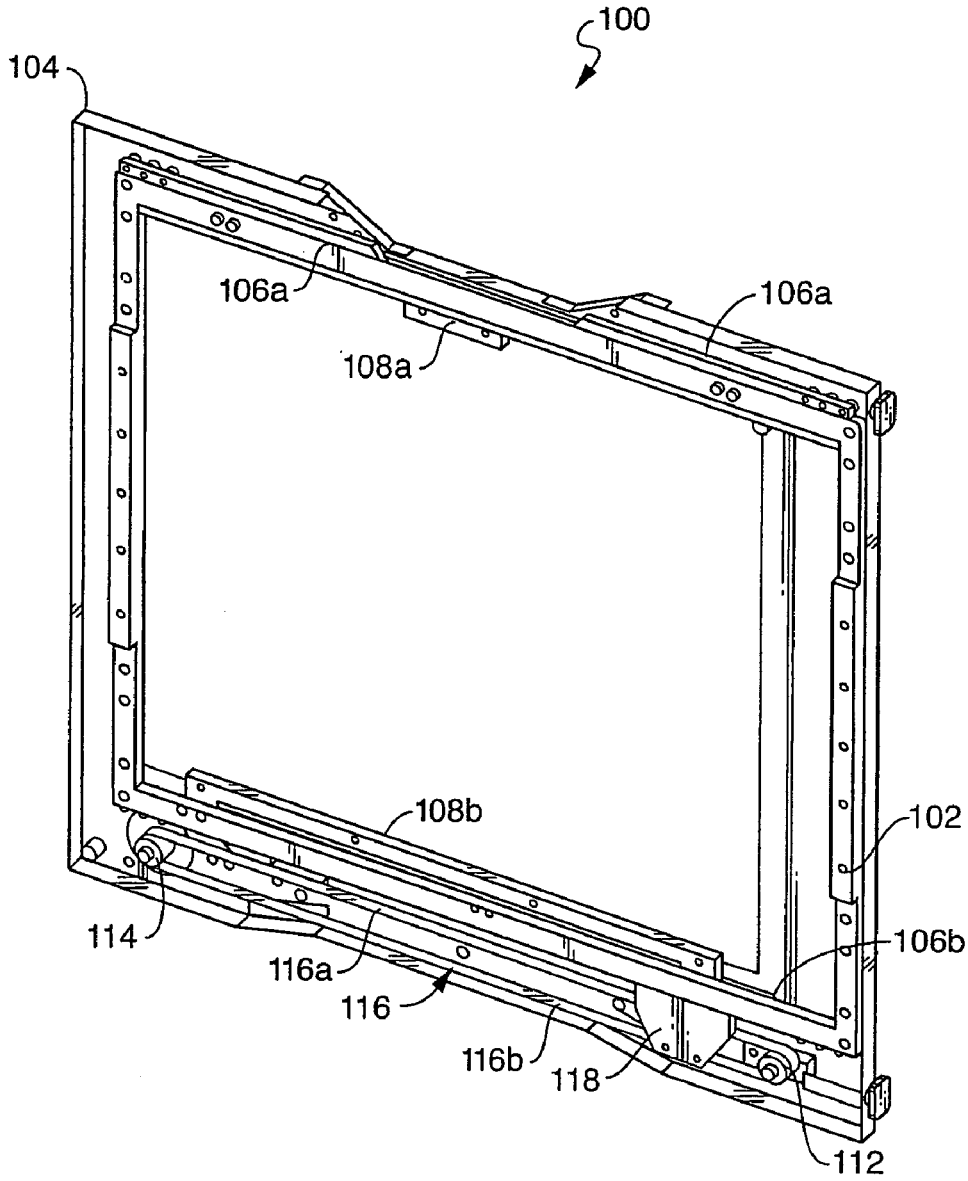
FIG. 5 is a front perspective view of the frame assembly and counter-weight of FIG. 4.
Figure 6:
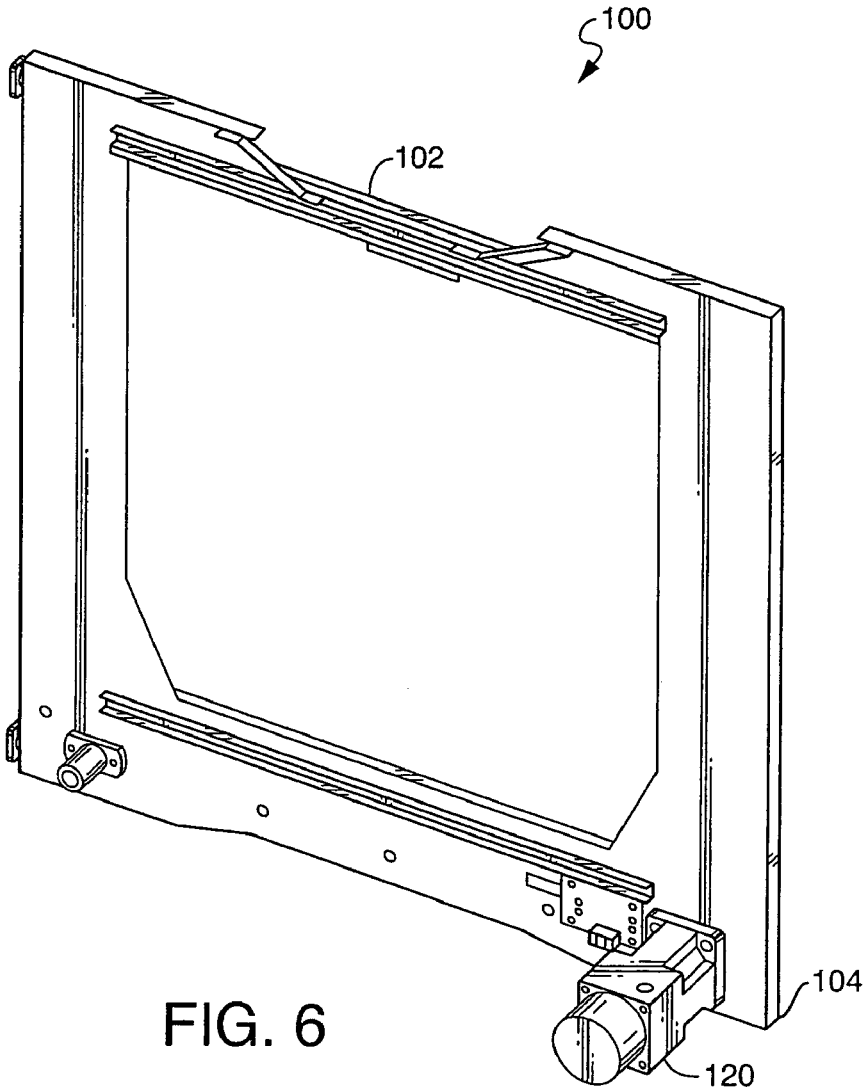
FIG. 6 is a rear perspective view of the frame assembly and the counter-weight of FIG. 4.

FIGS. 4 through 6 shown an exemplary embodiment of a portion of a Potter-Bucky device constructed in accordance with the present disclosure and including a frame assembly 100 for supporting a grid (not shown), wherein the frame assembly includes a counter-weight 102 for reducing or eliminating vibrations created by a grid mounted to the frame assembly 100 and moving in a reciprocating manner on the frame assembly 100.

The frame assembly 100 includes a frame 104, tracks 106*a*, 106*b* secured to the frame, a first set of brackets 108*a*, 108*b* slidably received in the tracks 106*a*, 106*b* for supporting a grid, and a second set of brackets 110*a*, 110*b*, 110*c* slidably received in the tracks 106*a*, 106*b*. The counter-weight 102 is secured to the second set of brackets 110*a*, 110*b*, 110*c*, as shown best in FIG. 4.

The frame assembly 100 also includes a drive pulley 112 and an idler pulley 114 secured to the frame 104, and a continuous belt 116 extending around the drive pulley 112 and the idler pulley 114 such that the belt 116 is divided into first and second portions 116*a*, 116*b* which move in opposite directions between the pulleys 112, 114 upon rotation of the drive pulley 112. The one of the first set of brackets 108*b* is secured to the first portion 116*a* of the continuous belt 116 and the counter-weight 102 is secured to the second portion 116*b* of the continuous belt 116 (through clamp 118), such that the counter-weight 102 will move in reciprocating directions opposite a grid secured to the first set of brackets 108*a*, 108*b*. The counter-weight 102 reduces or eliminates vibrations created by reciprocating movement of a grid secured to the frame assembly 100. As shown, best in FIG. 6, the frame assembly 100 also includes a reversible motor 120 connected to the drive pulley 112 for causing reciprocating movement of the belt 116.

It should be further understood that the embodiments of the present disclosure described herein are merely exemplary and that a person skilled in the art may make variations and modifications to the embodiments described without departing from the spirit and scope of the present disclosure. For example, other types of cams and springs can be used with a Potter-Bucky device constructed in accordance with the present disclosure. All such equivalent variations and modifications are intended to be included within the scope of this disclosure as defined by the appended claims.

What is claimed is:

1. A Potter-Bucky device for being positioned in a radiation image recording apparatus for exposing an image recording medium to radiation which has passed in a first plane through an object to the recording medium in order to record a radiation image of the object on the recording medium, comprising:

a grid movably supported for reciprocating motion in a second plane extending parallel to the recording medium between the object and the recording medium, wherein the grid is movable along an axis lying in the second plane;

at least one movable cam positioned adjacent the grid and causing reciprocating movement of the grid along the axis in the second plane parallel to the recording medium upon movement of the cam; and a counter-weight movably supported and operatively connected to the grid for reciprocating motion in the second plane along the axis in directions opposite the grid, wherein displacement of the center of gravity of the Potter-Bucky device due to movement of the grid is compensated for by the movement and mass of the counter-weight so as to prevent substantial vibration being transmitted from such movement to the radiation image recording apparatus.

2. A Potter-Bucky device as claimed in claim 1, wherein a mass of the grid is substantially equal to a mass of the counter-weight.

3. A Potter-Bucky device as claimed in claim 2, wherein an inertia of the grid is equal to an inertia of the counter-weight during reciprocating motion.

4. A Potter-Bucky device as claimed in claim 1, further comprising a motor operatively connected to the cam for causing movement of the cam adjacent the grid.

5. A Potter-Bucky device as claimed in claim 1, wherein the cam is positioned between the grid and the counter-weight.

6. A Potter-Bucky device as claimed in claim 1, further comprising at least one spring biasing the grid against the cam.

7. A Potter-Bucky device as claimed in claim 6, wherein the spring comprises a tension spring connected between the grid and the counter-weight and biasing the grid and the counter-weight against the cam.

8. A Potter-Bucky device as claimed in claim 6, wherein the spring comprises a compression spring, and the grid is positioned between the spring and the cam.

9. A Potter-Bucky device as claimed in claim 8, further comprising a second compression spring, and the counter-weight is positioned between the second compression spring and the cam.

10. A Potter-Bucky device as claimed in claim 1, wherein the cam is rotatable.

11. A Potter-Bucky device as claimed in claim 10, wherein the cam is elliptical.

12. A Potter-Bucky device as claimed in claim 1, wherein the grid is movably supported by linear bearings.

13. A method for moving a grid in a Potter-Bucky device, comprising:

movably supporting the grid for reciprocating motion along an axis in a plane;

positioning at least one movable cam adjacent the grid;

moving the cam to cause reciprocating movement of the grid along the axis in the plane; and attaching a counter-weight to the grid for reciprocating motion along the axis in the plane in directions opposite the grid, wherein displacement of the center of gravity of the Potter-Bucky device due to movement of the grid is compensated for by the movement and mass of the counter-weight so as to prevent substantial vibration being transmitted from such movement to the radiation image recording apparatus.

14. A method according to claim 13, wherein a mass of the grid is substantially equal to a mass of the counter-weight.

15. A method according to claim 13, wherein an inertia of the grid is equal to an inertia of the counter-weight during reciprocating motion.

16. A method according to claim 13, wherein the cam is positioned between the grid and the counter-weight.

17. A method according to claim 13, further comprising biasing the grid against the cam.

18. A method according to claim 13, further comprising biasing the counter-weight against the cam.

19. A method according to claim 13, wherein the cam is rotated.

20. A method according to claim 13, wherein the cam is elliptical.

21. A Potter-Bucky device, comprising:

a frame;

tracks secured to the frame;

a first set of brackets slidably received in the tracks for supporting a grid;

a grid secured to the first set of brackets;

a second set of brackets slidably received in the tracks;

a counter-weight secured to the second set of brackets;

wherein the grid and the counter-weight are adapted, positioned and oriented for reciprocating motion along a shared axis in a plane;

a drive pulley and an idler pulley secured to the frame; and a continuous belt extending around the drive pulley and the idler pulley such that the belt include first and second portions which move in opposite directions in the plane between the pulleys upon rotation of the drive pulley;

wherein the first set of brackets is secured to the first portion of the continuous belt and the counter-weight is secured to the second portion of the continuous belt so that the grid and the counter-weight move in opposite directions along the shared axis in the plane when the drive pulley is rotated, wherein displacement of the center of gravity of the Potter-Bucky device due to movement of the grid is compensated for by the movement and mass of the counter-weight so as to prevent substantial vibration being transmitted from such movement to the radiation image recording apparatus.

22. A Potter-Bucky device as claimed in claim 21, further comprising a reversible motor operatively connected to the drive pulley.

23. A Potter-Bucky device as claimed in claim 21, wherein a mass of the grid is substantially equal to a mass of the counter-weight.

24. A Potter-Bucky device as claimed in claim 21, wherein an inertia of the grid is equal to an inertia of the counter-weight during reciprocating motion.

* * * * *